US005105223A

United States Patent [19]

Bergen

[11] Patent Number: 5,105,223

[45] Date of Patent: Apr. 14, 1992

[54] SCREENED BLADE SCOROTRON

[75] Inventor: Richard F. Bergen, Ontario, N.Y.

[73] Assignee: Xerox Corporation, Stamford, Conn.

[21] Appl. No.: 694,152

[22] Filed: May 1, 1991

[51] Int. Cl.[5] ..... G03G 15/02

[52] U.S. Cl. ..... 355/225; 355/219; 355/221; 361/229; 361/230

[58] Field of Search ..... 355/219, 225, 221; 55/150, 157; 250/324–326; 361/229, 230, 233

[56] References Cited

U.S. PATENT DOCUMENTS

| | | | |
|---|---|---|---|
| 2,777,957 | 1/1957 | Walkup | 250/326 |
| 2,836,725 | 5/1958 | Vyverberg | 250/49.5 |
| 2,879,395 | 3/1959 | Walkup | 250/49.5 |
| 2,965,754 | 12/1960 | Bickmore et al. | 250/326 |
| 3,711,710 | 1/1973 | Wright | 250/49.5 |
| 3,936,635 | 2/1976 | Clark | 250/325 |
| 3,959,690 | 5/1976 | Leibrecht | 317/4 |
| 4,349,359 | 9/1982 | Fitch et al. | 55/151 |
| 4,414,603 | 11/1983 | Masuda | 361/227 |
| 4,591,713 | 5/1986 | Gundlach et al. | 250/326 |
| 4,626,876 | 12/1986 | Miyagawa et al. | 346/160 |
| 4,725,731 | 2/1988 | Lang | 250/326 |

*Primary Examiner*—A. T. Grimley

*Attorney, Agent, or Firm*—William A. Henry, II.

[57] ABSTRACT

A scorotron charging device for charging the surface of a receptor includes a ribbon coronode with a curvilinear field modifying screen surrounding a major portion of the ribbon to level the charge and decrease the possibility of arcing.

7 Claims, 2 Drawing Sheets

SCREENED BLADE SCOROTRON

Hereby cross-referenced, and incorporated herein by reference, are copending applications of the same assignee, including U.S. Ser. No. 07/544,560, entitled "NON-ARCING BLADE PRINTER" by Robert W. Gundlach and Richard F. Bergen, filed June 27, 1990 and U.S. Ser. No. 07/544,440, entitled "NON-ARCING BLADE SCREENED CORONODE" by Robert W. Gundlach and Richard F. Bergen, filed June 27, 1990.

FIELD OF THE INVENTION

The present invention relates to a charging device for depositing charge on an adjacent surface. More particularly, it is directed to a screened blade scorotron for use in such a device. The device is usable in a xerographic reproduction system for generating a uniform flow of ions onto an adjacent imaging surface for altering or changing the electrostatic charge thereon.

BACKGROUND OF THE INVENTION

In the electrophotographic reproducing arts, it is necessary to deposit a uniform electrostatic charge on an imaging surface, which charge is subsequently selectively dissipated by exposure to an information containing optical image to form an electrostatic latent image. The electrostatic latent image may then be developed and the developed image transferred to a support surface to form a final copy of the original document.

In addition to charging the imaging surface of a xerographic system prior to exposure, corona devices are used to perform a variety of other functions in the xerographic process. For example, corona devices aid in the transfer of an electrostatic toner image from a reusable photoreceptor to a transfer member, the tacking and detacking of paper to the imaging member, the conditioning of the imaging surface prior to, during, and after the deposition of toner thereon to improve the quality of the xerographic copy produced thereby.

Both D.C. and A.C. type corona devices are used to perform many of the above functions.

The conventional form of corona discharge devices for use in reproduction systems of the above type is shown generally in U.S. Pat. No. 2,836,725 in which a conductive corona electrode in the form of an elongated wire is connected to a corona generating D.C. voltage. The wire is partially surrounded by a conductive shield which is usually electrically grounded. The surface to be charged is spaced from the wire on the side opposite the shield and is mounted on a grounded substrate. Alternately, a corona device of the above type may be biased in a manner taught in U.S. Pat. No. 2,879,395 wherein an A.C. corona generating potential is applied to the conductive wire electrode and a D.C. potential is applied to the conductive shield partially surrounding the electrode to regulate the flow of ions from the electrode to the surface to be charged. Other biasing arrangements are known in the prior art and will not be discussed in great detail herein.

Some of the problems with these devices are that the wires have a propensity for vibration, singing and sagging, especially when they are used for charging over a wide area and it is difficult to use them placed closed to the surface to be charged. Also, they are sensitive to breakage as well as difficult to mount.

Various approaches to answering these problems have been tried in the past. For example, U.S. Pat. No. 3,711,710 discloses a corona charging system wherein a plurality of ion discharging coronodes, made from thin conductive strips, which charge the surface of a receiving medium within a document reproduction machine. U.S. Pat. No. 3,959,690 is directed to a corona charging element for an electrophotographic reproduction machine that includes a coronode member in the form of a metal strip with peaks on one side thereof alternately positioned in the plane of one side of the strip and then the other with the peaks having the shape of a four sided pyramid and one side of the pyramid lying in the plane of the surface of the strip which charges a conductive photoreceptor surface by discharging an ion charging current directly onto the photoreceptor surface. An electrostatic precipitator apparatus is disclosed in U.S. Pat. No. 4,349,359 that includes an ion generating electrode in the form of a long twisted strip that charges the surface of collecting plates. U.S. Pat. No. 4,626,876 discloses a solid state corona discharger that includes a pair of parallel strip-shaped A.C. electrodes that discharge an ion charging current onto the surface of a photosensitive member. A particle charging apparatus is shown in U.S. Pat. No. 4,414,603 that includes a group of parallel, narrow strip-shape corona electrodes which collectively discharge an electric field to within a designated charging space when activated by an A.C. source voltage. Although these attempts at solving the above-mentioned charging problem have had some success, they have not been entirely satisfactory.

SUMMARY OF THE INVENTION

Accordingly, an economical scorotron structure for uniform positive or negative charging is disclosed that employs a ribbon coronode which discharges an ion charging current onto a photoreceptor surface. The ribbon coronode is configured to be edge on and is partially surrounded by a partially cylindrical conductuve control screen that acts as a field spreading mechanism and thereby minimizes any propensity to arc. The field-modifying control screen also effects the ion field distribution at the coronode edge.

BRIEF DESCRIPTION OF THE DRAWINGS

The foregoing and other features of the instant invention will be more apparent from a further reading of the specification, claims and from the drawings in which:

DETAILED DESCRIPTION OF THE DRAWINGS

Figure 1:
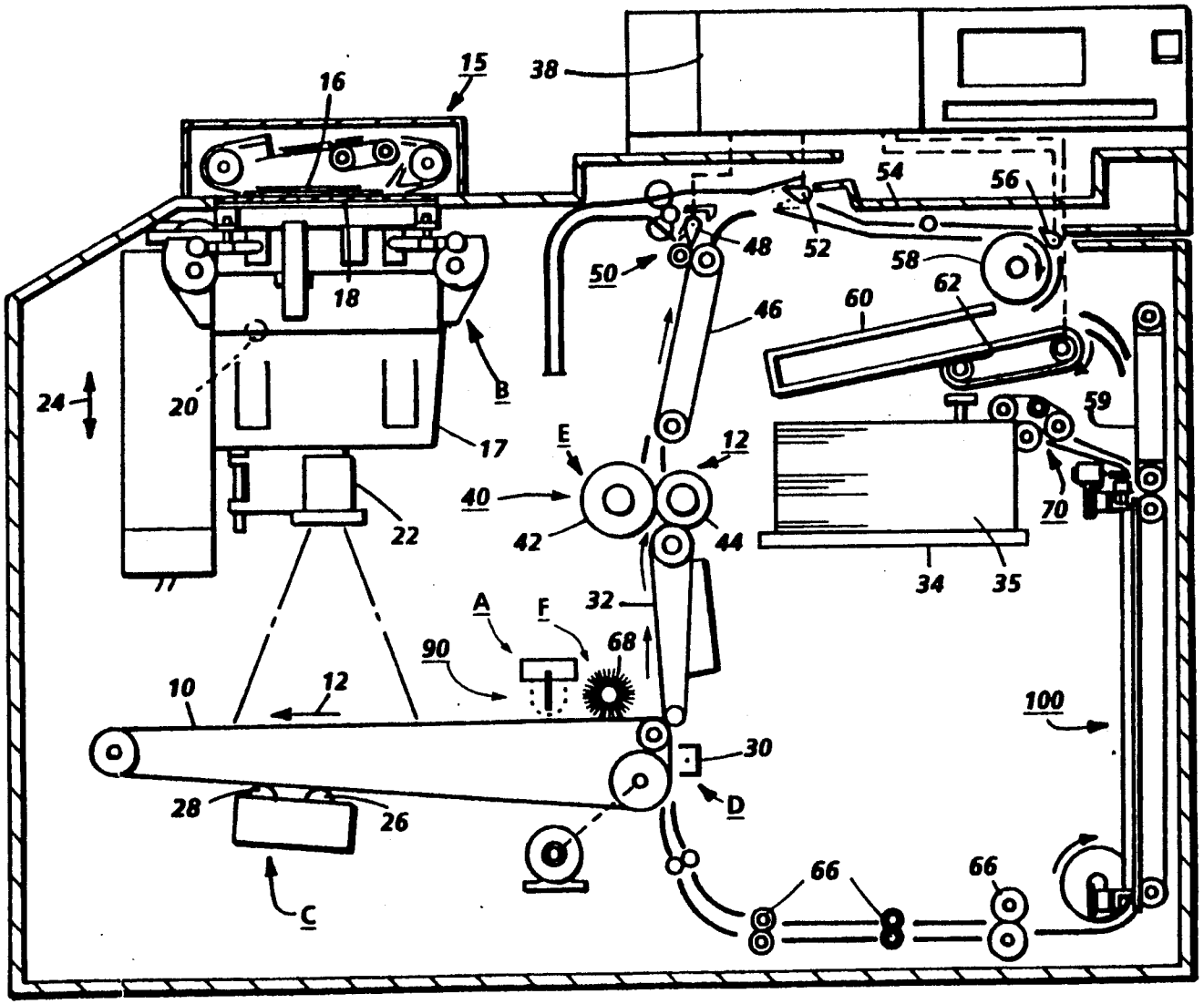
FIG. 1 is a schematic elevational view showing an electrophotographic copier employing the features of an aspect of the present invention.

For a general understanding of the features of the present invention, reference is had to the drawings. In the drawings, like reference numerals have been used throughout to designate identical elements. FIG. 1 schematically depicts the various components of an illustrative electrophotographic copying machine incorporating the improved charging apparatus of the present invention therein.

Inasmuch as the art of electrophotographic copying is well known, the various processing stations employed in the FIG. 1 copying machine will be shown hereinafter schematically and their operation described briefly with reference thereto.

As shown in FIG. 1, the illustrative electrophotographic printing machine employs a belt 10 having a photoconductive surface thereon. Preferably, the photoconductive surface is made from a selenium alloy. Belt 10 moves in the direction of arrow 12 to advance successive portions of the photoconductive surface through the various processing stations disposed about the path of movement thereof.

Initially, a portion of the photoconductive surface passes through charging station A. At charging station A, a corona generating device in accordance with the present invention, indicated generally by the reference numeral 90, charges the photoconductive surface to a relatively high substantially uniform potential.

Next, the charged portion of the photoconductive surface is advanced through imaging station B. At imaging station B, a document handling unit indicated generally by the reference numeral 15, positions original document 16 facedown over exposure system 17. The exposure system, indicated generally by reference numeral 17 includes lamp 20 which illuminates document 16 positioned on transparent platen 18. The light rays reflected from document 16 are transmitted through lens 22. Lens 22 focuses the light image of original document 16 onto the charged portion of the photoconductive surface of belt 10 to selectively dissipate the charge thereof. This records an electrostatic latent image on the photoconductive surface which corresponds to the information areas contained within the original document. Thereafter, belt 10 advances the electrostatic latent image recorded on the photoconductive surface to developement station C. Platen 18 is mounted movably and arranged to move in the direction of arrows 24 to adjust the magnification of the original document being reproduced. Lens 22 moves in synchronism therewith so as to focus the light image of original document 16 onto the charged portions of the photoconductive surface of belt 10.

Document handling unit 15 sequentially feeds documents from a stack of documents placed by the operator in a normal forward collated order in a document stacking and holding tray. The documents are fed from the holding tray in seriatim, to platen 18. The document handling unit recirculates documents back to the stack supported on the tray. Preferably, the document handling unit is adapted to serially sequentially feed the documents, which may be of various sizes and weights of paper or plastic containing information to be copied. The size of the original document disposed in the holding tray and the size of the copy sheet are measured.

While a document handling unit has been described, one skilled in the art will appreciate that the size of the original document may be measured at the platen rather than in the document handling unit. This is required for a copying or printing machine which does not include a document handling unit, or when one is making copies of A3 or 11"×17" documents where the document handler has to be raised up from the platen and the oversized document manually placed on the platen for copying.

With continued reference to FIG. 1, at development station C, a pair of magnetic brush developer rollers, indicated generally by the reference numerals 26 and 28, advance a developer material into contact with the electrostatic latent image. The latent image attracts toner particles from the carrier granules of the developer material to form a toner powder image on the photoconductive surface of belt 10.

After the electrostatic latent image recorded on the photoconductive surface of belt 10 is developed, belt 10 advances the toner powder image to transfer station D. At transfer station D, a copy sheet is moved into contact with the toner powder image. Transfer station D includes a corona generating device 30 which sprays ions onto the backside of the copy sheet. This attracts the toner powder image from the photoconductive surface of belt 10 to the sheet. After transfer, conveyor 32 advances the sheet to fusing station E.

The copy sheets are fed from tray 34 to transfer station D. The tray senses the size of the copy sheets and sends an electrical signal indicative thereof to a microprocessor within controller 38. Similarly, the holding tray of document handling unit 15 includes switches thereon which detect the size of the original document and generate an electrical signal indicative thereof which is transmitted also to a microprocessor controller 38.

Fusing station E includes a fuser assembly, indicated generally by the reference numeral 40, which permanetly affixes the transferred powder image to the copy sheet. Preferably, fuser assembly 40 includes a heated fuser roller 42 and backup roller 44. The sheet passes between fuser roller 42 and backup roller 44 with the powder image contacting fuser roller 42. In this manner, the powder image is permanently affixed to the sheet.

After fusing, conveyor 46 transports the sheets to gate 48 which functions as an inverter selector. Depending upon the position of gate 48, the copy sheets will either be deflected into a sheet inverter 50 or bypass sheet inverter 50 and be fed directly onto a second decision gate 52. Thus, copy sheets which bypass inverter 50 turn a 90° corner in the sheet path before reaching gate 52. Gate 48 directs the sheets into a face up orientation so that the imaged side which has been transferred and fused is face up. If inverter path 50 is selected, the opposite is true, i.e., the last printed face is facedown. Second decision gate 52 deflects the sheet directly into an output tray 54 or deflects the sheet into a transport path which carries it on without inversion to a third decision gate 56. Gate 56 either passes the sheets directly on without inversion into the output path of the copier, or deflects the sheets into a duplex inverter roll transport 58. Inverting transport 58 inverts and stacks the sheets to be duplexed in a duplex tray 60 when gate 56 so directs. Duplex tray 60 provides intermediate or buffer storage for those sheets which have been printed on one side and on which an image will be subsequently printed on the side opposed thereto, i.e., the copy sheets being duplexed. Due to the sheet inverting by roller 58, these buffer set sheets are stacked in duplex tray 60 facedown. They are stacked in duplex tray 60 on top of one another in the order in which they are copied.

In order to complete duplex copying, the previously simplexed sheets in tray 60 are fed to conveyor 59 seriatim by bottom feeder 62 back to transfer station D for transfer of the toner powder image to the opposed side of the sheet. Conveyors 100 and 66 advance the sheet along a path which produces an inversion thereof. However, inasmuch as the bottommost sheet is fed from duplex tray 60, the proper or clean side of the copy sheet is positioned in contact with belt 10 at transfer station D so that the toner powder image thereon is transferred thereto. The duplex sheets are then fed through the same path as the previously simplexed sheets to be stacked in tray 54 for subsequent removal by the printing machine operator.

Returning now to the operation of the printing machine, invariably after the copy sheet is separated from the photoconductive surface of belt 10, some residual particles remain adhering to belt 10. These residual particles are removed from the photoconductive surface thereof at cleaning station F. Cleaning station F includes a rotatably mounted fibrous brush 68 in contact with photoconductive surface of belt 10. These particles are cleaned from the photoconductive surface of belt 10 by the rotation of brush 68 in contact therewith. Subsequent to cleaning, a discharge lamp (not shown) floods the photoconductive surface with light to dissipate any residual electrostatic charge remaining thereon prior to the charging thereof for the next successive imaging cycle.

Figure 2:
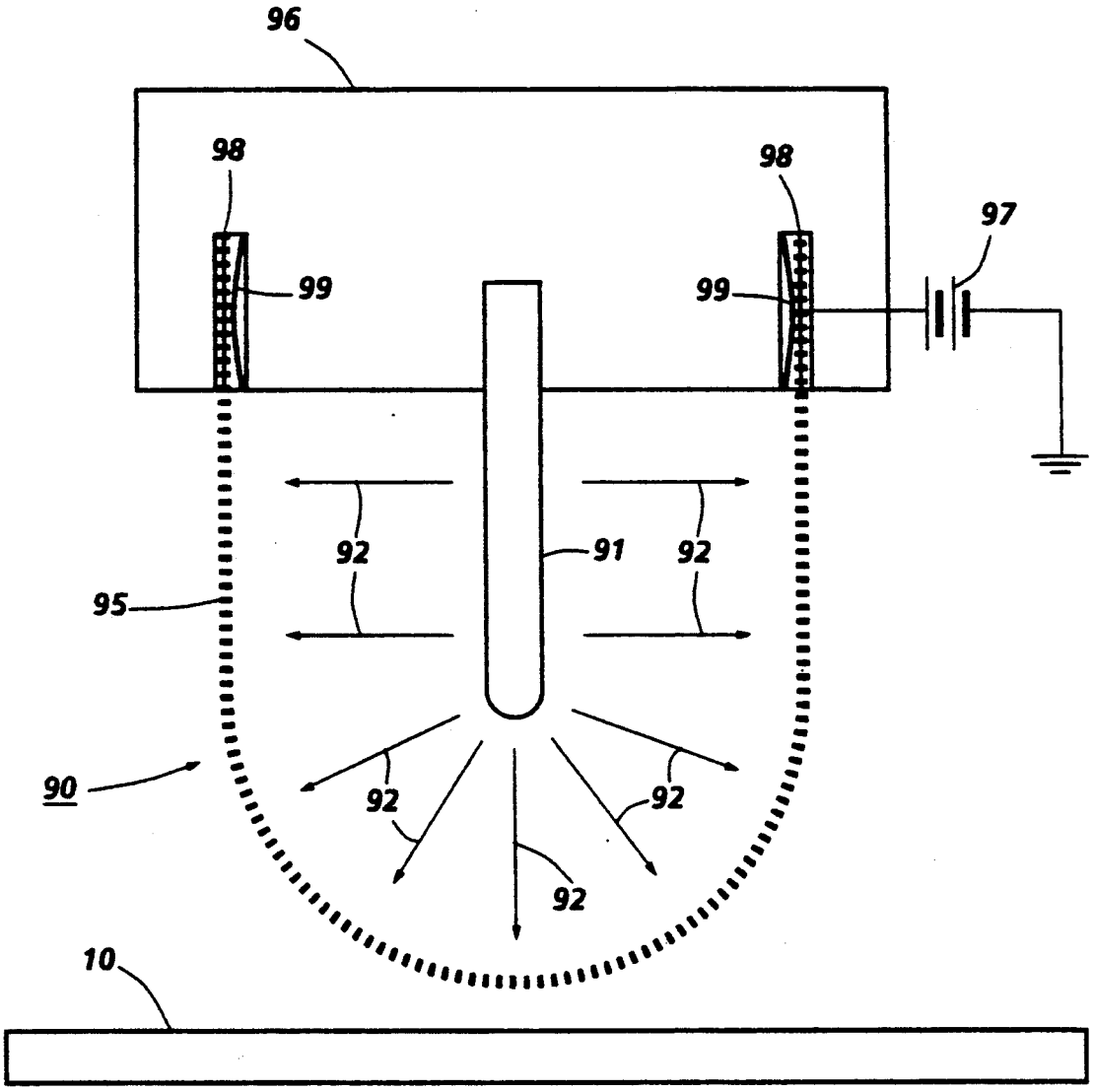
FIG. 2 shows a side view of the charging device of FIG. 1 and the present invention employed as the scorotron charging unit.

Turning now to an aspect of the present invention, and in reference to FIG. 2, scorotron 90 is positioned in a perpendicular plane with respect to the photoreceptor 10 and comprises a coronode in the form of a grounded thin (about 1–15 mils thick) conductive ribbon 91. A conductive control screen 95 is curved around opposite sides of ribbon 91 for a purpose that will be explained hereinafter. The curved screen has a U-shaped profile with a curvilinear portion surrounding the radius of the ribbon 91 and upstanding substantially straight side portions on opposite sides of the ribbon. The upstanding portions are substantially parallel with the sides of the ribbon. The curvilinear portion of the screen is useful to shape the field lines from the ribbon and expand the ion flow region at the tip of the ribbon which in turn reduces arcing. The upstanding side portions of the screen serve to reduce arcing by attracting the field lines from the ribbon and thereby allow the field lines that carry ions toward the receiver to expand. Ribbon coronode 91 has a number of advantages over a wire coronode. The ribbon or blade 91 is a rigid structure and is not as difficult to mount as stringing a wire; not sensitive to breakage, singing, or sagging that create problems with thin wire coronodes; and can be precisely positioned. One concern with a ribbon or blade, however, is its tendency to arc. This is possibly because, in addition to its higher capacitance, the fields are less divergent from the corona emitting edge than they are from a wire. Fields from a wire exceed the Paschen limit for air breakdown only in a small region surrounding its surface. This results in an ionization region enveloping the wire. From a blade, the ionization region will be larger, and, in fact, the fields across the entire gap to the receiver surface are higher than desirable. That is, the extra conducting surface at high potential that extends above the corona emitting edge raises the potential of all of the space around the edge of a ribbon. The voltage required to produce corona is thereby increased, but also the second derivative of voltage with respect to distance toward the ground plane is lowered. In other words, the high fields extend further toward the receiver forming a narrow, dense stream of charges that have a propensity to arc. Whereas in the case of the wire, fields diminish more quickly with distance from the coronode.

An answer to this possible arcing problem with blade charging is shown in FIG. 2 as comprising a bent or cylindrical conductive control screen 95 used in conjunction with ribbon coronode 90 to yield a scorotron with resistance to arcing because of the field spreading effect of the screen. As seen in FIG. 2, the field lines represented by arrows 92 emanate from ribbon 91 and are directed toward screen 95. Screen 95 is bent and is secured with spacers 99 within slot 98 of support block 96 to radius the ribbon edges. The screen is closely spaced to the receiver surface such that fringing fields between the screen and receiver surface contribute significantly both to efficient ion pumping and to potential leveling. The screen is biased at 97 to establish a reference potential so that when the receiver surface reaches the screen voltage, the fields no longer drive ions to the receiver, but rather to the screen. Therefore, the screen acts as a field spreading mechanism which reduces the magnitude of the field near the ribbon edge spreading the stream of charges over a substantial region, and therefore, reducing the tendency of the device to arc. In addition, there is a uniform field in the region where the screen runs parallel to the ribbon. Though the field does not carry charges, it beneficially effects the field distribution at the ribbon edge. In tests, excellent uniformity was obtained with scorotron 90 with a current of 25 $\mu$a/cm to ribbon 91 and a photoreceptor process speed of 12"/sec. The scorotron can be used for ion producing purposes other than as a charging device, e.g., it could be employed as a transfer or detack device.

Scorotron 90 allows for a broad distribution of corona to the receptor or distribution of the ions with the use of screen 95. Typically, less than 15% of ions will travel to a receptor in an electrographic copier that employs a wire/conductor corotron. In contrast, curvilinear screen 95 as configured in FIG. 2 alters the field or expands the field lines to increase travel of ions toward receiver 10 while simultaneously minimizing the possibility of arcing. Conductive control screen 95 accepts some current ensuring that all additional current from the ribbon 91 will flow to the receptor.

Scorotron 90 is a particularly economical structure for uniform charging in that support member or base 96 is plastic and can be extruded. The screen can be machine fed into appropriate slots 98 in support member 96 which makes for reduced manufacturing costs. In short, this scorotron design is amenable to robotic manufacturing. In addition, scorotron 90 is especially suited for machines, such as, the Xerox 2510® Engineering Copier that copies onto copy sheets or rolls up to 36" wide and many feet in length since no sagging of ribbon 91 is possible over long lengths. It is possible to accomplish negative charging with the present invention by using a sawtooth coronode.

It should now be apparent that a scorotron device is disclosed in which the coronode comprises a small radius conductive strip that is configured edge-on (or mounted orthogonal to the receiver surface) with a conductive screen that is bent and loaded to curvilinearly radius the coronode edge. This configuration is significant in that it tailors the field line distribution to provide maximum charge flow to the receptor with minimum possibility of arcing.

While this invention has been described with reference to the structures disclosed herein, they are not confined to the details as set forth and are intended to cover modifications and changes that may come within the scope of the following claims.

What is claimed is:

1. A scorotron charging device adapted to apply a uniform charge to a charge retentive surface, comprising:

an insulative support member;

a corona producing means in the form of a thin conductive strip secured to said support member and configured edge-on so as to present a small radius toward the surface to be charged;

a conductive control screen including a curvilinear first portion thereof positioned to surround said small radius of said conductive strip;

low voltage means connected to said control screen to energize said control screen in order to control surface potential on the charge retentive surface; and high voltage means connected to said corona producing means and adapted to apply sufficient voltage to said corona producing means that corona ions are emitted from said corona producing means toward a surface to be charged, and wherein said conductive control screen includes a second portion thereof that is parallel to and extends along opposite sides of said conductive strip and acts as a field spreading mechanism which reduces the magnitude of the field near the edge of said conductive strip, thereby spreading the stream of ions emitted from said conductive strip over a substantial region in order to provide maximum charge to a surface to be charged while simultaneously minimizing arcing.

2. The scorotron charging device of claim 1, wherein said conductive strip is about 1–15 mils thick.

3. The scorotron charging device of claim 1, wherein said conductive control screen is secured in recesses of said insulative support member, and wherein said recesses include spacer means therein for securing said conductive strip to said support member.

4. The scorotron charging device of claim 1, wherein said corona producing means and said control screen are each biased with a positive voltage.

5. The scorotron charging device of claim 1, wherein said corona producing means and said control screen are each biased with a negative voltage.

6. The scorotron charging device of claim 1, wherein said control screen includes side portions that are substantially parallel with side portions of said corona producing means in order to attract field lines emminating from said corona producing means.

7. In a printing apparatus that places page image information onto copy sheets, the improvement of a scorotron charging a photoconductive surface within said printer, characterized by:

a corona producing means in the form of a thin conductive strip configured edge-on so as to present a small radius toward the surface to be charged;

a curvilinear conductive control screen positioned to surround said small radius of said conductive strip;

means for applying a low voltage to said control screen in order to energize said control screen and control the surface potential of the surface to be charged; and high voltage means connected to said corona producing means and adapted to apply sufficient voltage to said corona producing means that corona ions are emitted from said corona producing means toward a surface to be charged, and wherein said curvilinear conductive control screen includes a portion thereof that is parallel to and extends along opposite sides of said conductive strip and acts as a field spreading mechanism which reduces the magnitude of the field near the edge of said conductive strip, thereby spreading the stream of ions from said conductive strip over a substantial region in order to provide maximum charge to a surface to be charged with minimal possibility of arcing.

* * * * *